US007506782B2

(12) United States Patent
Walters et al.

(10) Patent No.: US 7,506,782 B2
(45) **Date of Patent: *Mar. 24, 2009**

(54) SINGLE USE UNIT DOSAGE DISPENSING CLOSURE

(76) Inventors: Ronald J Walters, RD 1 Box 78, Columbus, PA (US) 16405; Robert J Smith, 12835 Forrest Dr., Edinboro, PA (US) 16412

( * ) Notice: Subject to any disclaimer, the term of this patent is extended or adjusted under 35 U.S.C. 154(b) by 418 days.

This patent is subject to a terminal disclaimer.

(21) Appl. No.: 11/024,365

(22) Filed: Dec. 24, 2004

(65) Prior Publication Data

US 2005/0236424 A1 Oct. 27, 2005

(51) Int. Cl.
*B67D 5/00* (2006.01)

(52) U.S. Cl. ..... 222/83; 222/145.5; 222/153.05; 222/153.06; 222/153.09; 222/325; 222/541.2; 206/219; 206/222

(58) Field of Classification Search ..... 222/80–83, 222/145.5, 327, 153.06, 153.05, 153.09, 222/541.2, 325, 520–525, 541.9; 206/219–222
See application file for complete search history.

(56) References Cited

U.S. PATENT DOCUMENTS

| | | | | | |
|---|---|---|---|---|---|
| 2,631,521 | A | | 3/1953 | Atkins, Jr. | |
| 2,859,898 | A | | 11/1958 | Mendenhall | |
| 3,156,369 | A | * | 11/1964 | Bowes et al. | 206/222 |
| 3,404,811 | A | * | 10/1968 | Cernei | 222/83 |
| 3,521,745 | A | | 7/1970 | Schwartzman | |
| 3,603,469 | A | | 9/1971 | Magni | |
| 3,655,035 | A | | 4/1972 | Muhlbauer | |
| 3,715,189 | A | | 2/1973 | Nighohossian et al. | |
| 3,841,467 | A | | 10/1974 | Hansen | |
| 3,968,872 | A | | 7/1976 | Cavazza | |
| 4,011,945 | A | | 3/1977 | Bourne et al. | |
| 4,195,731 | A | | 4/1980 | Cavazza | |
| 4,203,517 | A | * | 5/1980 | Hildebrandt et al. | 206/221 |
| 4,221,291 | A | | 9/1980 | Hunt | |
| 4,315,570 | A | | 2/1982 | Silver et al. | |
| 4,615,437 | A | | 10/1986 | Finke et al. | |
| 4,682,689 | A | * | 7/1987 | Pereira et al. | 206/222 |
| 4,693,366 | A | * | 9/1987 | Goncalves | 206/222 |
| 4,757,916 | A | * | 7/1988 | Goncalves | 222/83 |
| 4,776,972 | A | | 10/1988 | Barrett | |
| 4,805,799 | A | * | 2/1989 | Robbins, III | 366/348 |
| 4,858,759 | A | | 8/1989 | Mauthe et al. | |
| 4,858,760 | A | | 8/1989 | Di Sturco | |
| 4,898,293 | A | | 2/1990 | Morel | |
| 4,903,865 | A | | 2/1990 | Janowitz | |
| 4,982,875 | A | * | 1/1991 | Pozzi et al. | 222/83 |
| 5,029,718 | A | | 7/1991 | Rizzardi | |

(Continued)

*Primary Examiner*—Frederick C. Nicolas

(57) ABSTRACT

A single use unit dosage dispensing closure includes a shell attached to a container, an axial movable cap attached to the shell, a dust cover preventing premature actuation of the cap, and a sealing member coupled to the cap. The shell has an inner guide in communication with the container and the cap is moveable along the guide. The cap has a chamber adapted to dispense material into the container. The chamber is sealed with the sealing member extending across a lower open end thereof, wherein axial movement of the cap along the inner guide member will open the chamber and dispense the contents of the chamber into the container. The axial movable cap is formed from a material with a higher oxygen and moisture barrier property than the material forming the shell.

20 Claims, 4 Drawing Sheets

U.S. PATENT DOCUMENTS 5,038,951 A 8/1991 Rizzardi
5,246,142 A 9/1993 DiPalma et al.
5,380,315 A * 1/1995 Isono et al. ..... 604/416
5,419,445 A 5/1995 Kaesemeyer
5,474,209 A * 12/1995 Vallet Mas et al. ..... 222/83
5,509,530 A 4/1996 Wilson
5,697,495 A 12/1997 Abrams et al.
5,772,017 A 6/1998 Kang
5,813,570 A * 9/1998 Fuchs et al. ..... 222/82
5,941,380 A 8/1999 Rothman
5,950,819 A 9/1999 Sellars
6,092,648 A 7/2000 Sellars
6,098,795 A 8/2000 Mollstam et al.
6,138,821 A 10/2000 Hsu
6,165,523 A 12/2000 Story
6,170,654 B1 1/2001 Gartner et al.
6,224,922 B1 5/2001 Fonte
6,305,576 B1 10/2001 Leoncavallo
6,372,270 B1 4/2002 Denny
6,820,740 B1 11/2004 Spector
6,921,087 B2 * 7/2005 Takahashi et al. ..... 277/628
6,935,493 B2 * 8/2005 Cho ..... 206/222
6,959,839 B2 * 11/2005 Roth et al. ..... 222/83
6,962,254 B2 11/2005 Spector
D514,949 S 2/2006 Dalton et al.
D515,934 S 2/2006 Dalton et al.
7,169,419 B2 1/2007 Dalton et al.
7,249,690 B2 * 7/2007 Smith et al. ..... 222/83
2003/0072850 A1 4/2003 Burniski
2004/0026270 A1 2/2004 Liang
2004/0161504 A1 8/2004 Daniels et al.
2005/0218015 A1 10/2005 Spector

* cited by examiner

Fig 4
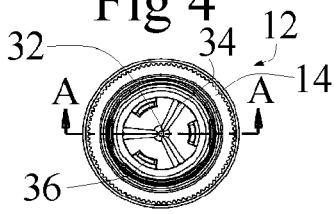
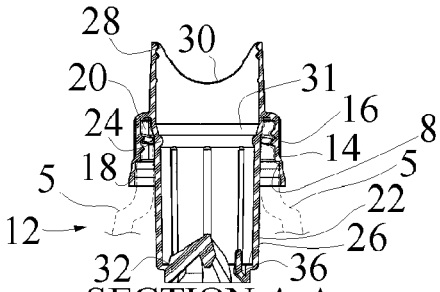
SECTION A-A
Fig 6
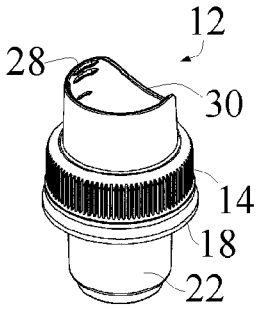
Fig 1
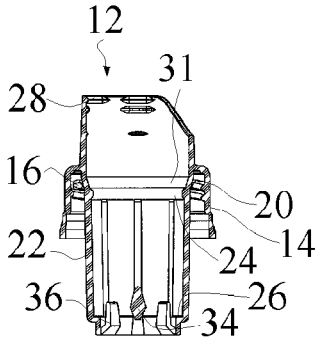
SECTION B-B
Fig 7
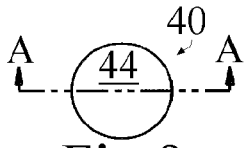
Fig 9
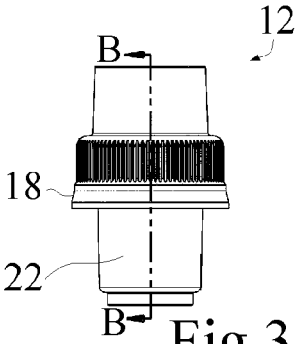
Fig 3
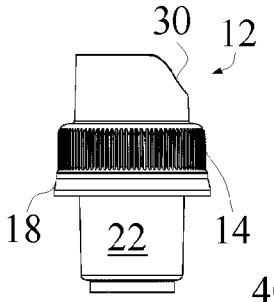
Fig 2
Fig 8
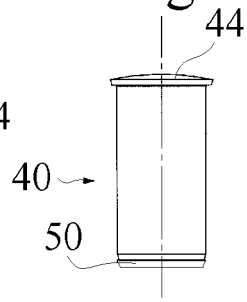
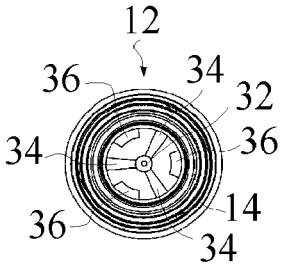
Fig 5
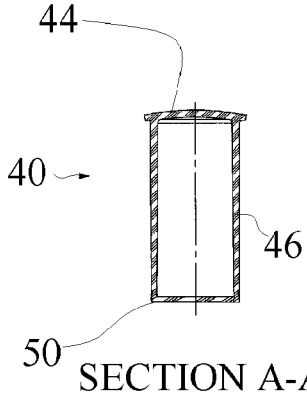
SECTION A-A
Fig 10

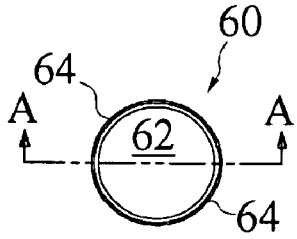
Fig 13
Fig 14
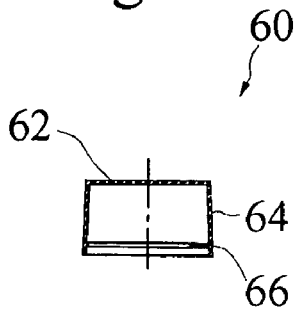
Section A-A
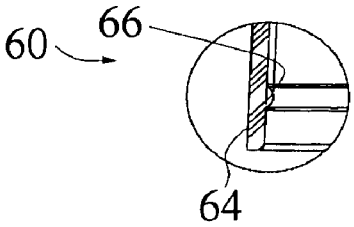
Fig 15
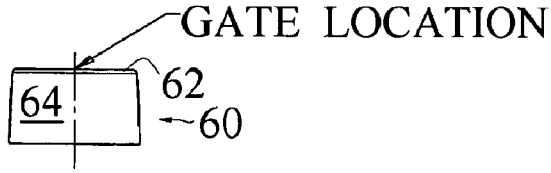
Fig 11
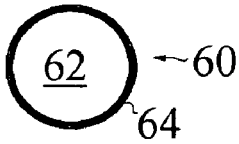
Fig 12

SINGLE USE UNIT DOSAGE DISPENSING CLOSURE

BACKGROUND OF THE INVENTION

1. Field of the Invention

The present invention relates to cap dispensing closures for a container, more particularly to closures having a chamber in the cap that can selectively store and dispense the contents there-of into the container.

2. Prior Art

The broad concept of a container closure including a compartment for storing material separate from the container for selectively mixing with the container is very old and well known.

U.S. Pat. No. 3,521,745 discloses a container with two compartments and a piercing member used to rupture the wall between the compartments to allow the material stored in one compartment to mix with the material in the other.

U.S. Pat. No. 3,603,469 discloses a container closure having a cap that forms an interior chamber or reservoir for storing a substance. A reciprocating piercing member is used to rupture the reservoir to allow the material stored in the reservoir to mix with the material in the container.

U.S. Pat. No. 3,715,189 discloses a container with a completely open top (i.e. no neck finish) with a top cover that includes an interior chamber or reservoir for storing a substance. A plunger is used to rupture the reservoir to allow the material stored in the reservoir to mix with the material in the container.

U.S. Pat. No. 3,968,872 discloses a container closure having a cap that forms an interior chamber or reservoir for storing a substance. A piercing member is used to rupture the reservoir to allow the material stored in the reservoir to mix with the material in the container.

U.S. Pat. No. 4,195,731 discloses a container closure having a cap that forms an interior chamber or reservoir for storing a substance. A piercing piston is used to rupture the reservoir to allow the material stored in the reservoir to mix with the material in the container.

U.S. Pat. No. 4,221,291 discloses a container closure having a cap that forms an interior chamber or reservoir for storing a substance. A plunger or rod is connected to the bottom wall of the reservoir and is used to rupture the reservoir to allow the material stored in the reservoir to mix with the material in the container.

U.S. Pat. No. 4,615,437 discloses a threaded container closure or cap that forms an interior chamber or reservoir for storing a substance. A bottom wall of the reservoir is held in position by the bottle neck finish and further threading of the upper portion of the cap onto the bottle is used to rupture the reservoir to allow the material stored in the reservoir to mix with the material in the container.

U.S. Pat. No. 4,858,760 discloses a container closure having a cap that forms an interior chamber or reservoir for storing a substance. A bottom wall of the reservoir is ruptured by a piecing plunger to allow the material stored in the reservoir to mix with the material in the container.

U.S. Pat. No. 4,903,865 discloses a threaded container closure or cap that forms an interior chamber or reservoir for storing a substance. A bottom wall of the reservoir is held in position by the bottle neck finish and movement of a reciprocating plunger on the cap into the bottle is used to rupture the reservoir to allow the material stored in the reservoir to mix with the material in the container.

U.S. Pat. No. 5,029,718 discloses a container closure or cap that forms an interior chamber or reservoir for storing a substance. A bottom wall of the reservoir is held in position by the bottle neck finish and movement of a reciprocating plunger on the cap into the bottle is used to rupture the reservoir to allow the material stored in the reservoir to mix with the material in the container.

U.S. Pat. No. 5,038,951 discloses a container closure or cap that forms an interior chamber or reservoir for storing a substance. A bottom wall of the reservoir is held in position by the bottle neck finish and movement of a reciprocating plunger on the cap into the bottle is used to rupture the reservoir to allow the material stored in the reservoir to mix with the material in the container.

U.S. Pat. No. 5,772,017 discloses a threaded container closure or cap that forms an interior chamber or reservoir for storing a substance. A bottom wall of the reservoir is ruptured through movement of a threaded reciprocating piecing member on the cap to allow the material stored in the reservoir to mix with the material in the container.

U.S. Pat. No. 5,950,819 discloses a threaded container closure or cap that forms an interior chamber or reservoir for storing a substance. The reservoir is held in position by the bottle neck finish and movement of a top of the cap into the bottle is used to rupture the side walls of the reservoir to allow the material stored in the reservoir to mix with the material in the container.

U.S. Pat. No. 6,165,523 discloses a threaded container closure or cap that forms an interior chamber or reservoir for storing a substance. The reservoir is collapsible and has a piecing member for piercing the bottom wall thereof during compression to rupture the reservoir to allow the material stored in the reservoir to mix with the material in the container.

U.S. Pat. No. 6,224,922 discloses a container closure or cap that forms multiple colorants reservoirs for selectively dispensing into the container to selectively color the beverage in the container.

U.S. Pat. No. 6,305,576 discloses a threaded container closure or cap that forms an "aseptic" interior chamber or reservoir for storing a substance. A bottom wall of the reservoir is pieced by a movement of a reciprocating piercing member to allow the material stored in the reservoir to mix with the material in the container.

U.S. Pat. No. 6,372,270 discloses a container closure or cap that forms an interior chamber or reservoir for storing a substance. A bottom wall of the reservoir is ruptured by movement of a reciprocating plunger on the cap into the bottle to allow the material stored in the reservoir to mix with the material in the container.

As noted above wide variety of cap dispensing, or cap ejecting, closures are known in the art. The prior art devices have certain drawbacks. Many of these earlier designs do not allow for the formation of the cap chamber out of a high moisture/oxygen barrier material. Materials that form a high moisture/oxygen barrier are generally too rigid to form undercuts that can be jumped out of a mold. Materials that can economically form the components do not yield the high moisture/oxygen barrier and limits the applicability of the closure (e.g. certain material in the chamber would have a low shelf life due to the material selection for the cap). Further, many of these prior art designs are impractical from a standpoint of filling the chamber or reservoir in the closure.

It is an object of the present invention to overcome the drawbacks of the prior art and provide an economical unit dosage dispensing closure with high moisture/oxygen barrier characteristics for the chamber and which is easily filled having a long shelf life.

SUMMARY OF THE INVENTION

The above objects are achieved with a single use unit dosage dispensing closure according to the present invention. The closure according to the invention includes a shell adapted to be attached to a container, an axial movable cap attached to the shell, a cover preventing premature actuation of the cap, and a sealing member coupled to the cap. The shell has an inner guide with an open end in communication with the container and the cap is moveable along the inner guide. The cap is axially movable along the inner guide. The cap has a chamber adapted to hold a unit dosage of material to be dispensed into the container. The chamber is sealed with the sealing member extending across a lower open end of the cap, wherein axial movement of the cap along the inner guide will pierce or otherwise remove the sealing member to dispense the contents of the chamber into the container. The axial movable cap is formed from a material with a higher oxygen and moisture barrier property than the material forming the shell.

The cap may be formed from polyethylene terephthalate, nylon, polypropylene with low shrink filler, or polyethylene with low shrink filler. The low shrink filler may be talc or mica, and the shell may be formed of a polyolefin material.

The shell may have an outer skirt with a closure attaching mechanism, such as a thread, on the outer skirt for attaching the shell to the container. A tamper evident band can be placed on a lower end of the outer skirt. A tamper evident band may be placed around the cap to prevent premature dispensing of the contents of the chamber.

The shell may further include a piercing element, wherein axial movement of the cap along the inner guide member will cause the piercing element to pierce the sealing film and dispense the contents of the chamber into the container. The piercing element may include a plurality of angled radial blades at a lower end of the inner guide, wherein the radial blades converge to form a piercing tip extending toward the upper end of the inner guide. Further, the invention may include folding elements to move the sealing member out of the way to further assist in dispensing.

The inner guide may be an annular tube having annular seals engaging and sealing against the cap, wherein the inner guide includes an upper stop limiting the upward movement of the cap and a finger access in an upper side of the inner guide. The cap may have a top and a cylindrical side member forming the chamber.

One embodiment of the present invention forms the closure as a three piece structure with a rotating actuator provided for axially moving the cap. Another modification moves the sealing member from the cap to the shell, wherein the sealing member is pierced by the axial movement of the cap. A further embodiment forms the rotating actuator as a dispensing tip, with a seal between the cap and the dispensing tip that is opened as the cap is actually moved from the dispensing tip which movement will also pierce or otherwise remove the sealing member.

These and other advantages of the present invention will be clarified in the brief description of the preferred embodiment in connection with the attached figures in which like reference numerals represent like elements throughout.

BRIEF DESCRIPTION OF THE DRAWINGS

FIG. 1 is a perspective view of a shell of a closure according to the present invention;

FIG. 2 is a side elevation view of the shell of FIG. 1;

FIG. 3 is a front elevation view of the shell of FIG. 1;

FIG. 4 is a top plan view of the shell of FIG. 1;

FIG. 5 is a bottom plan view of the shell of FIG. 1;

FIG. 6 is a front section view of the shell of FIG. 1 taken along section line A-A in FIG. 4;

FIG. 7 is a side section view of the shell of FIG. 1 taken along section line B-B of FIG. 3;

FIG. 8 is a side elevation view of a cap of a closure according to the present invention;

FIG. 9 is a top plan view of the cap of FIG. 8;

FIG. 10 is a section of the cap of FIG. 8 taken along section line A-A of FIG. 9;

FIG. 11 is a side elevation view of a dust cover a closure according to the present invention;

FIG. 12 is a top plan view of the cover of FIG. 11;

FIG. 13 is a bottom plan view of the cover of FIG. 11;

FIG. 14 is a section of the cover of FIG. 11 taken along section line A-A of FIG. 13;

FIG. 15 is an enlarged view of the section view of FIG. 14;

DESCRIPTION OF THE PREFFERRED EMBODIMENTS

Figure 16:
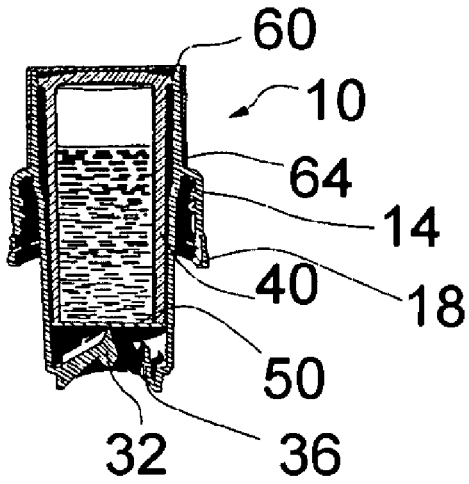
FIG. 16 is a sectional of the closure according to the present invention, with a cap thereof in a closed sealed position.
Figure 17:
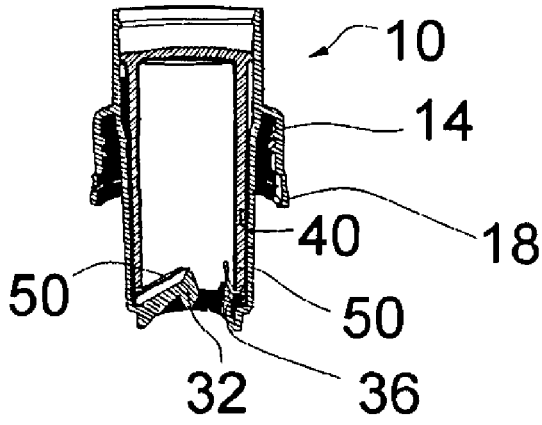
FIG. 17 is a sectional of the closure according to the present invention, with a cap thereof in the open, dispensing position.

A single use unit dosage dispensing closure 10 according to the present invention is shown in the figures. The closure 10 is adapted to be attached to a container 5 (shown in FIG. 6 in phantom) with a threaded neck finish 8 (e.g. a bottle).

The closure includes a shell 12, shown alone in FIGS. 1-7, which is adapted to be attached to the container. The shell has an outer skirt 14 with a closure attaching mechanism in the form of threads 16 on the outer skirt 14 for attaching the shell 12 to the container. The lower portion 18 of the skirt 14 may be formed as a tamper evident band, as is known in the art. The inner surface of the skirt may include a sealing ring 20 for sealing against the neck finish of the container.

The shell 12 has a tubular inner guide 22 with an open lower end in communication with the interior of the container. The inner guide 22 includes at least one sealing ring 24, a lower stop 26 at a lower end thereof and an upper stop 28 at an upper end thereof. The inner guide 22 further includes a finger access 30 adjacent an upper end thereof and a second stop 31 above the seal ring 24. The shell 12 may further include an alignment nub on the exterior of the guide 22 for alignment of the guide during manufacturing.

A piercing element 32 is formed integral with the inner guide 22. The piercing element 32 is formed a plurality of angled radial blades 34 at a lower end of the inner guide 22, wherein the radial blades 34 converge to form a piercing tip extending toward the upper end of the inner guide 22. The triangular center piercing tip gives a center point for gating of the shell 12. Adjacent the blades 34 are folding elements 36 that are adapted to engage and fold back a sealing element to facilitate discharge of the unit dosage as will be described.

An important aspect of the present invention is that all of the major seals, undercuts and other "jump" features (i.e. elements that effectively deform slightly in the de-molding process) are formed in or integral with the shell 12. The shell is made of a polymer that accommodates such features, such as polyolefin. Materials that accommodate these jump features do not have significant moisture or gas barrier properties (i.e. high moisture and gas permeability).

An axial movable cap 40, shown separately in FIGS. 8-10, is attached to the shell 12 and moveable along the inner guide 22. The cap 40 defines an inner chamber 42 therein adapted to hold a unit dosage of material to be dispensed into the container. The cap 40 is of a simple configuration having a top 44 and a cylindrical side member 46 forming the chamber 42. The simple construction (no jump features) of the cap 40 allows a relatively rigid material to be used to form the cap 40, whereby the cap 40 and the shell 12 are made from different polymer materials. In other words, the axial movable cap 40 is formed from a material with a higher oxygen and water barrier property than the material forming the shell 12. The cap 40 may, preferably, be formed a rigid material such as polyethylene terephthalate (PET), nylon, polypropylene (PP) with low shrink filler, and polyethylene (PE) with low shrink filler. Low shrink fillers include talc and mica.

A sealing layer, or even film, 50 is coupled to the cap 40 at least prior to dispensing with the cap 40, wherein the chamber 42 is sealed with the sealing layer 50 extending across a lower open end of the cap 40 at the open end of the cylindrical side member 46. Axial movement of the cap 40 along the inner guide 22 will cause the piercing element formed by blades 34 to pierce the sealing layer 50 and dispense the contents of the chamber 42 into the container. Following the piercing of the layer 50, the folding elements 36 engage the distinct pieces of the sealing layer and move them out of the way to further assist in the dispensing. The layer 50 may be a metallic foil or a plastic film. The sealing ring 24 of the guide 22 engages and seals against the cylindrical side member 46. The upper stop 28 and the second stop 31 engage against the top 44 to limit the respective axial motion of the cap 40. The lower stop 26 engages against the lower end of the cylindrical side member 46.

The closure additionally includes a dust cover 60 shown in FIGS. 11-14. The dust cover has a top 62 with an extending cylindrical skirt 64. A coupling bead 66 will engage the shell 20. The cover 60 is removed prior to actuation of the dispensing closure and can further include tamper evident band for security. The shell 20 would include associated engaging beads for such tamper evident bands, as generally known in the art. The addition of the dust cover 60 may further assist in the stacking of vertical containers. Further, the dust cover 60 prevents premature actuation of the cap 40, since the cap 40 cannot be pressed downward until the cover 60 is removed.

Figure 18:
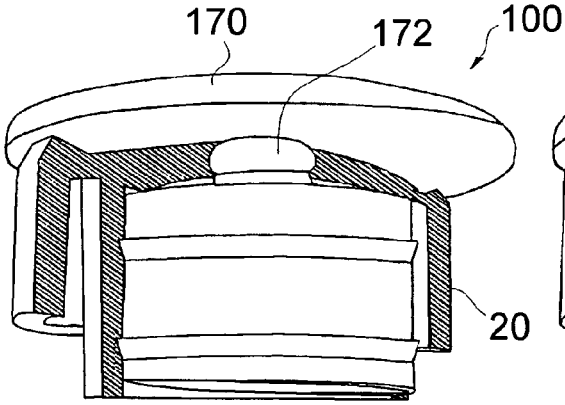
FIG. 18 is a schematic view, partially in section of a modified three piece closure according to the present invention.

There are numerous variations of the concepts included in the closure of the present invention, although the above described embodiment is the most preferred and believed to offer the most advantages in manufacturing and operation. A review of alternatives shown in FIGS. 18-21 may be helpful. FIG. 18 is a schematic view, partially in section of a modified three piece closure 100 according to the present invention. The closure 100 includes a shell 120 and cap 140 similar in function and operation as the shell 20 and cap 40 described above. The details of the shell 120, such as the piercing elements, are not shown and can be formed the same as shell 20. The difference in this embodiment is that the actuation of the axial movement of the cap 140 is though a rotational actuator 170 attached to the cap 140. A threaded shaft 172 extends from the actuator top 174, through the shell 120, and engages the cap 140. This design shows seals 142 on the cap 140 and requires a more complex cap construction for the attachment of the shaft 172 to the cap 142 and for the formation of an anti-rotation mechanism (not shown) between the cap 140 and the shell 120 {e.g. a sliding key in an axial slot). The more complex cap construction may minimize the choices of material for forming the cap 140, therefore the earlier embodiment is preferred.

Figure 19:
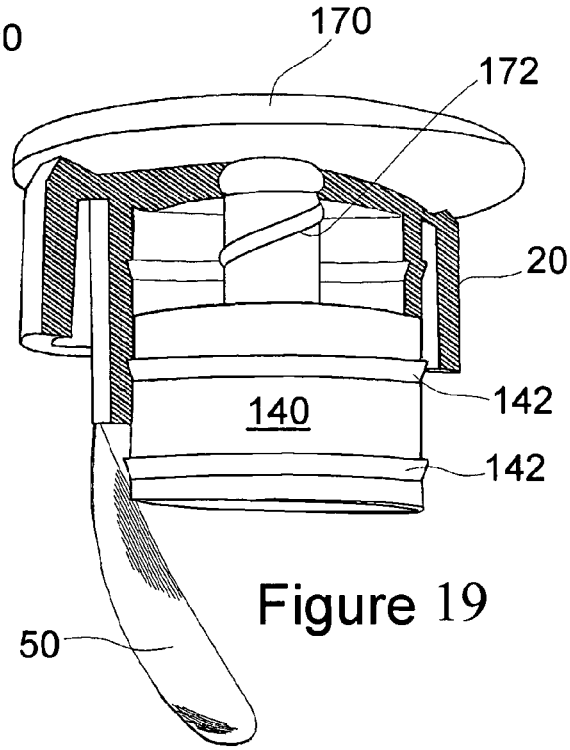
FIG. 19 is a schematic view, partially in section of a further modified three piece closure according to the present invention.

FIG. 19 is a schematic view, partially in section of a further modified three piece closure 100 according to the present invention. This embodiment is essentially the same as described in FIG. 18, except that the sealing member 50 is attached to a lower end of the shell 120 (and piercing elements thereof are omitted). This embodiment uses the lower end of the cap 140 as a piercing element and requires a good seal between the cap 140 and the shell 120. The complex cap 140 may be less advantageous than the cap 40 of the first design.

Figure 20:
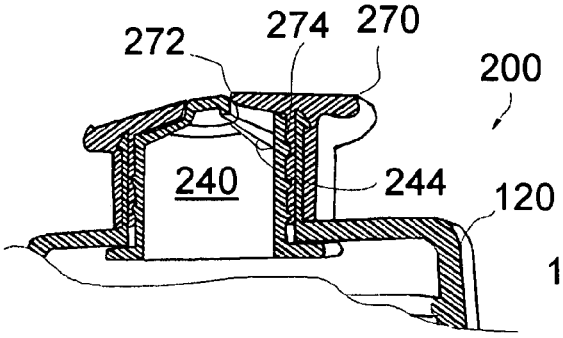
FIG. 20 is a schematic view, partially in section of another modified three piece closure according to the present invention.
Figure 21:
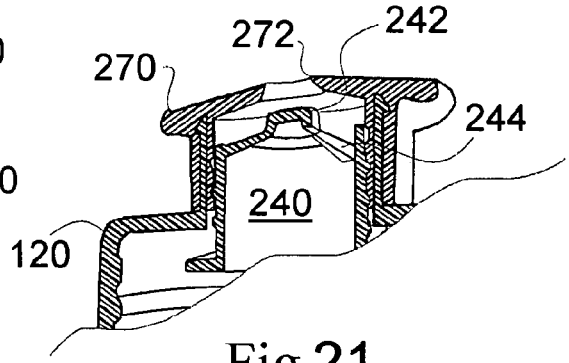
FIG. 21 is a schematic view of the closure of FIG. 20 in a dispensing position.

FIGS. 20-21 are schematic views, partially in section of another modified three piece closure 200 according to the present invention. This embodiment is essentially the same as described in FIG. 18, except that the rotational actuator is in the form of a dispensing tip 270 having a central opening 272 therein. The threaded shaft is replaced with an internally threaded skirt 274. The cap 240 further includes a sealing plug 242 closing the central opening 272 when the cap 240 is in the uppermost position shown in FIG. 20, and at least one opening 244 there-through to form a flow path when in the fully opened position and the foil or sealing layer has been removed or ruptured. The structure removing the sealing layer is not shown in detail but may be formed essentially as shown above. The cap 240 is essentially an axial movable stem similar to stems of push pull closures (except in standard push pull closures the tip is slid away and toward the stem as opposed to vice-versa as in this closure). As shown in FIG. 21 the closure 200 is a dispensing closure once the cap 240 is moved away from the tip 270 and the sealing layer 50 is removed thereby opening the flow path from interior of the container to the exterior (as well as dispensing the contents of the cap into the container).

It will be apparent that various modifications can be made to the present invention without departing from the spirit and scope thereof. The scope of the present invention is intended to be defined by the appended claims and equivalents thereof.

What is claimed is:

1. A single use unit dosage dispensing closure comprising:

a shell adapted to be attached to a container, the shell having an outer skirt with a closure attaching mechanism on the outer skirt for attaching the shell to the container, the shell having an inner guide with an open top, wherein the inner guide is an annular tube having at least one annular seal;

an axial movable cap attached to the shell and moveable along the inner guide through the open top, the cap having a chamber therein adapted to hold a unit dosage of material to be dispensed into the container, wherein each annular seal is engaging and sealing against the cap throughout a movement of the cap;

a cover removably attached to the shell covering the open top thereby preventing actuation of the cap by an operator until the cover has been removed; and a sealing layer coupled to the cap, wherein the chamber is sealed with the sealing layer extending across a lower open end of the cap, wherein axial movement of the cap after the cover has been removed along the inner guide will cause the sealing layer to be removed or ruptured to dispense the contents of the chamber into the container.

2. The closure of claim 1 wherein the cap and the shell are made from different polymer materials.

3. The closure of claim 2 wherein the cap is formed from one of the group consisting of polyethylene terephthalate, nylon, polypropylene with low shrink filler, and polyethylene with low shrink filler.

4. The closure of claim 3 wherein the shell is formed of a polyolefin material.

5. The closure of claim 1 wherein the closure attaching mechanism on the outer skirt for attaching the shell to the container are threads and the shell has a tamper evident band on a lower portion of the outer skirt.

6. The closure of claim 1 wherein the inner guide is an annular tube having at least one annular seal engaging and sealing against the cap.

7. The closure of claim 1 wherein the cover includes a tamper evident band.

8. The closure of claim 1 wherein the cap is formed from one of the group consisting of polyethylene terephthalate, nylon, polypropylene with low shrink filler, and polyethylene with low shrink filler.

9. The closure of claim 1 wherein the cap has a top and a cylindrical side member forming the chamber.

10. A single use unit dosage dispensing closure comprising:

a shell adapted to be attached to a container, the shell having an outer skirt with a closure attaching mechanism on the outer skirt for attaching the shell to the container, the shell having an inner guide with an open top;

an axial movable cap attached to the shell and moveable along the inner guide through the open top, the cap having a chamber therein adapted to hold a unit dosage of material to be dispensed into the container, wherein the cap and the shell are made from different polymer materials, and wherein the cap is formed from one of the group polypropylene with low shrink filler and polyethylene with low shrink filler, wherein the low shrink filler is one of the group consisting of talc and mica;

a cover removably attached to the shell covering the open top thereby preventing actuation of the cap by an operator until the cover has been removed; and a sealing layer coupled to the cap, wherein the chamber is sealed with the sealing layer extending across a lower open end of the cap, wherein axial movement of the cap after the cover has been removed along the inner guide will cause the sealing layer to be removed or ruptured to dispense the unit dosage of the material of the chamber into the container.

11. A single use unit dosage dispensing closure comprising:

a shell adapted to be attached to a container, the shell having an outer skirt with a closure attaching mechanism on the outer skirt for attaching the shell to the container, the shell having an inner guide with an open top, wherein the inner guide is an annular tube having at least one annular seal engaging and sealing against the cap;

an axial movable cap attached to the shell and moveable along the inner guide through the open top, the cap having a chamber therein adapted to hold a unit dosage of material to be dispensed into the container, and wherein the inner guide includes an upper stop limiting the upward movement of the cap;

a cover removably attached to the shell covering the open top thereby preventing actuation of the cap by an operator until the cover has been removed; and a sealing layer coupled to the cap, wherein the chamber is sealed with the sealing layer extending across a lower open end of the cap, wherein axial movement of the cap after the cover has been removed along the inner guide will cause the sealing layer to be removed or ruptured to dispense the unit dosage of the material of the chamber into the container.

12. The closure of claim 11 wherein the inner guide includes a finger access in an upper side of the inner guide that is accessible after the cover has been removed.

13. A single use unit dosage dispensing closure comprising:

a shell adapted to be attached to a container, the shell having an inner guide with open ends in communication with the container, wherein the inner guide is an annular tube having at least one annular seal;

a dust cover removably attached to the shell covering one open end thereby preventing actuation of the cap by an operator until the cover has been removed;

an axial movable cap attached to the shell and moveable along the inner guide, the cap engaging the inner guide and having a chamber therein adapted to hold a unit dosage of material to be dispensed into the container, wherein the axial movable cap is formed from a material with a higher oxygen and water barrier property than the material forming the shell, and wherein each annular seal is engaging and sealing against the cap throughout a movement of the cap; and a sealing member coupled to the cap, wherein the chamber is sealed with the sealing member extending across a lower open end of the chamber, wherein axial movement of the cap along the inner guide member will dispense the unit dosage of the material of the chamber into the container.

14. The closure of claim 13 wherein the shell has an outer skirt with a closure attaching mechanism on the outer skirt for attaching the shell to the container.

15. The closure of claim 13 wherein the cap is formed from one of the group consisting of polyethylene terephthalate, nylon, polypropylene with low shrink filler, and polyethylene with low shrink filler.

16. The closure of claim 13 wherein the cap is formed from one of the group polypropylene with low shrink filler and polyethylene with low shrink filler, wherein the low shrink filler is one of the group consisting of talc and mica.

17. The closure of claim 13 wherein the shell is formed of a polyolefin material and the cap is formed from one of the group consisting of polyethylene terephthalate, nylon, polypropylene with low shrink filler, and polyethylene with low shrink filler.

18. The closure of claim 13 further including a tamper evident band on the dust cover at an upper end of the inner guide.

19. The closure of claim 13 wherein the shell includes an outer skirt having a closure attaching mechanism on the outer skirt for attaching the shell to the container in the form of threads and wherein the shell has a tamper evident band on a lower portion of the outer skirt.

20. A single use unit dosage dispensing closure comprising:

a shell adapted to be attached to a container, the shell having an inner guide with open ends in communication with the container;

a dust cover removably attached to the shell covering one open end thereby preventing actuation of the cap by an operator until the cover has been removed;

an axial movable cap attached to the shell and moveable along the inner guide, the cap engaging the inner guide and having a chamber therein adapted to hold a unit dosage of material to be dispensed into the container, wherein the axial movable cap is formed from a material with a higher oxygen and water barrier property than a material forming the shell, and wherein the inner guide is an annular tube having at least one annular seal engaging and sealing against the cap with an upper stop limiting the upward movement of the cap and a finger access in an upper side of the inner guide; and a sealing member coupled to the cap, wherein the chamber is sealed with the sealing member extending across a lower open end of the chamber, wherein axial movement of the cap along the inner guide member will dispense the unit dosage of the material of the chamber into the container.

* * * * *